US006579330B2

(12) United States Patent
Nakahama et al.

(10) Patent No.: US 6,579,330 B2
(45) Date of Patent: Jun. 17, 2003

(54) ALTERNATIVE FUEL TO GASOLINE

(75) Inventors: Minoru Nakahama, River side Yomiuri S502, 36-1, Hakozaki-cho, Nihonbashi, Chuo-ku, Tokyo 103-0015 (JP); Hiroshi Inayoshi, Tokorozawa (JP)

(73) Assignee: Minoru Nakahama, Tokyo (JP)

( * ) Notice: Subject to any disclaimer, the term of this patent is extended or adjusted under 35 U.S.C. 154(b) by 0 days.

(21) Appl. No.: 09/884,999

(22) Filed: Jun. 21, 2001

(65) Prior Publication Data

US 2002/0026745 A1 Mar. 7, 2002

(30) Foreign Application Priority Data

Jun. 23, 2000 (JP) ..... 2000-189844

(51) Int. Cl.[7] ..... C10L 1/18
(52) U.S. Cl. ..... 44/452; 44/451
(58) Field of Search ..... 44/436, 451, 452

(56) References Cited

U.S. PATENT DOCUMENTS

| | | | | | |
|---|---|---|---|---|---|
| 2,404,094 | A | * | 7/1946 | Robertson | 44/451 |
| 4,242,100 | A | * | 12/1980 | Parker et al. | 44/451 |
| 4,357,146 | A | * | 11/1982 | Heeren | 44/451 |
| 4,595,395 | A | | 6/1986 | Smith | |
| 5,697,987 | A | * | 12/1997 | Paul | 44/352 |
| 6,120,566 | A | * | 9/2000 | Mifune et al. | 44/451 |
| 6,309,430 | B1 | * | 10/2001 | Paul | 44/352 |

FOREIGN PATENT DOCUMENTS

| | | |
|---|---|---|
| GB | 669037 | 3/1952 |

OTHER PUBLICATIONS

Patent Abstracts of Japan—vol. 1998, No. 1, Jan. 30, 1998 & JP 09 227880 A (Nishimura Kunio), Sep. 2, 1997—abstract.

Patent Abstracts of Japan—vol. 11, No. 394 (C–465), Dec. 23, 1987 & JP 62 156195 A (Chobe Taguchi), Jul. 11, 1987—abstract.

* cited by examiner

*Primary Examiner*—Cephia D. Toomer
(74) *Attorney, Agent, or Firm*—Armstrong, Westerman & Hattori, LLP

(57) ABSTRACT

The development of a fuel that is an alternative fuel to gasoline for internal combustion engines, which does not discharge toxic gases such as sulfur oxide that causes pollution, is low-pollution, and yet is highly efficient with a high output of power. An alternative fuel to gasoline including alcohol as the principal component, said alcohol comprising a mixed alcohol of 51~60 percentage by weight of ethanol and/or methanol and isopropyl alcohol and isobutanol (mixing ratio: 9~6:1.5~0.5:2~1), 20 plus or minus 5 percentage by weight of paraffinic hydrocarbon of five to eight carbon atoms, and 30 plus or minus 5 percentage by weight of toluene, maintaining an output equal to that of gasoline, yet without the need to be used with gasoline or reformed gasoline, and in addition decreasing the generation of toxic gases such as sulfur oxide and the like.

2 Claims, No Drawings

ALTERNATIVE FUEL TO GASOLINE

FIELD OF THE INVENTION

The present invention relates to an alternative fuel to gasoline including alcohol as the principal component; specifically, an alternative fuel to gasoline including a mixed alcohol comprising several types of alcohol, a paraffinic hydrocarbon of five to eight carbon atoms and toluene, having a high output of power, is highly efficient and yet is low-pollution.

DESCRIPTION OF THE RELATED ART

Influence on health by air pollutants such as sulfur oxide ($SO_x$), nitrogen oxide ($NO_x$), carbon monoxide (CO), heavy metals and dust that are emitted into the atmosphere upon combustion of gasoline or light oil and the like in internal combustion engines, or the influence of such pollutants on the natural environment as acid rain has been gaining social attention as pollution issues.

On the other hand, from the perspective that petroleum is a limited resource, and that the distribution of oil-producing areas are uneven, social requests such as energy conservation and efficient use of resources have driven the development for an alternative fuel to petroleum, out of which various synfuels have been proposed.

However, most of the synfuels so far (mainly alcohol fuel) could not generate as much combustion power as that of gasoline, and when such synfuel could produce an equivalent level of combustion power, a special combustion device was necessary to burn it. Therefore, although various synfuels have been proposed, it can be said that not one has been put to practical use on its own as a fuel for internal combustion engines, and the reality is that such synfuels are only used in limited cases from the point of saving petroleum, as alcohol fuel in which alcohol is mixed with gasoline.

For instance, as a fuel that does not contain gasoline, Japanese Patent Publication No. 57-50839 proposes a synfuel made of alcohol mixed with hydrogen peroxide in order to increase its combustion power (quantity of heat). However, as described in this gazette, this synfuel has the problem of having to conduct air conditioning by reforming the intake opening and the like of the inlet manifold, and further, although its output and fuel consumption are described to be equal to that of gasoline, because of the instability of hydrogen peroxide, and because of its handling difficulties such as requiring a long time to mix, it is hardly put to practical use.

On the other hand, the Japanese Laid-Open Patent Publication No. 5-140568 proposes a fuel composite consisting of reformed gasoline, methanol and butanol at a mixing ratio of approximately 2:2:1, with antirust and pigment added. However, experiment on the fuel composite described in the above-mentioned gazette revealed that the high combustion temperature causes the temperature of the engine to rise too much, thereby accelerating the deterioration of the packing that comprise structural parts of the engine, and moreover, because of this heat, there were problems such that even the mechanical parts of the internal combustion engine were easily damaged, and that in certain internal combustion engines, it was apt to cause knocking.

Furthermore, in the Japanese Laid-Open Patent Publication No. 9-227880, a synfuel made by blending alcohol and toluene in reformed gasoline was proposed, and in the Japanese Laid-Open Patent Publication No. 8-283751, an attempt to render the aforementioned synfuel low-pollution was made by processing it with an inorganic substance and the like.

However, although all of the synfuels mentioned above effectively decreased the amount of CO and HC in the exhaust gas, since reformed gasoline contains a large amount of sulfur and also toxic substances such as benzene, these synfuels fail to solve thoroughly the pollution problems arising from exhaust gas. Moreover, because reformed gasoline varies in the element composition according to the origin of petroleum and method of reformation, the differences in the properties of each that arise from such variation makes it difficult to regulate the synfuel at a consistent quality. Therefore, depending on the reformed gasoline that is blended, the performance of such synfuel becomes uneven, so that differences occur in its antiknock quality, or that the required horsepower is not generated.

SUMMARY OF THE INVENTION

The present invention aims to provide a low-pollution synfuel that restrains the emission of air pollutants such as CO, HC, and $CO_2$, has equal performance to gasoline in terms of output and fuel efficiency, but yet is usable in existing internal combustion engines for gasoline without making any modifications.

The most distinctive feature of the present invention is the fact that paraffinic hydrocarbon of five to eight carbon atoms is mixed with a fuel of which alcohol is a principal component, and further, by mixing paraffinic hydrocarbon of five to eight carbon atoms and toluene with a mixed alcohol comprising several different types of alcohol, a new, and moreover, low-pollution fuel for internal combustion engines, with no gasoline included, maintaining equal or more combustion power of gasoline, was successfully developed.

That is, the present invention provides an alternative fuel to gasoline, described in (1) to (5) below.

(1) An alternative fuel to gasoline, said fuel including alcohol as the principal component; wherein said fuel includes a paraffinic hydrocarbon of five to eight carbon atoms.

(2) An alternative fuel to gasoline, said fuel including alcohol as the principal component; wherein said fuel includes a paraffinic hydrocarbon of five to eight carbon atoms and toluene.

(3) An alternative fuel to gasoline described in 1 or 2 above, wherein said paraffinic hydrocarbon is hexane.

(4) An alternative fuel to gasoline, said fuel including alcohol as the principal component; wherein said alcohol is a mixed alcohol of ethanol and/or methanol and isopropyl alcohol and isobutanol; and said alternative fuel to gasoline includes said mixed alcohol and hexane and toluene.

(5) An alternative fuel to gasoline, said fuel including alcohol as the principal component; wherein said alcohol is a mixed alcohol of 9~6:1.5~0.5:2~1 weight ratio of ethanol and/or methanol and isopropyl alcohol and isobutanol; and said alternative fuel to gasoline includes a fuel comprised of 51~60 percentage by weight of said mixed alcohol with 20 plus or minus 5 percentage by weight of hexane and 30 plus or minus 5 percentage by weight of toluene.

A detailed explanation of the present invention will follow.

DETAILED DESCRIPTION OF PREFERRED EMBODIMENTS

In the fuel of the present invention, it can be said that the paraffinic hydrocarbon of five to eight carbon atoms play an important role in producing the fuel properties that may well replace gasoline. It is considered that the paraffinic hydrocarbon of five to eight carbon atoms against alcohol becomes an octane booster, contributing to the improvement of antiknock quality. Furthermore, the use of paraffinic hydrocarbon of five to eight carbon atoms with toluene increases the combustion output of alcohol, thereby giving this fuel a performance that can easily stand comparison with gasoline as a fuel for internal combustion engines. In addition, said paraffinic hydrocarbon of five to eight carbon atoms is an extremely stable substance, further having the effect of a dehydrator. Therefore, because said paraffinic hydrocarbon of five to eight carbon atoms act to prevent drops of water during storage, the fuel properties of the fuel of the present invention will not deteriorate even under long-term preservation, thus meeting the important requisite for a fuel, that is, the advantage of being safe and easy to handle.

Alcohol, which is the principal component, will not gain the properties of a fuel for an internal combustion engine, when ethanol or methanol is used alone. In order to obtain the properties that would replace gasoline would necessitate the use of several types of alcohol in combination, and a mixed alcohol, comprising three or four combinations comprising ethanol and/or methanol and isopropyl alcohol and isobutanol was the most suitable combination.

In most types of alcohol fuel in the past, either methanol or ethanol was used, and it can be said that the use of two kinds of alcohol together, namely isopropyl alcohol and isobutanol, is also one of the distinctive features of the present invention. The desirable composition therefor is a composition existing in the range of 9~6:1.5~0.5:2~1 by weight ratio.

The desirable mixing ratio of the above-mentioned mixed alcohol, paraffinic hydrocarbon of five to eight carbon atoms and toluene, is a composition comprising 51~60 percentage by weight of mixed alcohol, 20 plus or minus 5 percentage by weight of said paraffinic hydrocarbon, and 30 plus or minus 5 percentage by weight of toluene. Especially when mixing ratio of alcohol falls out of this range, undesirable conditions occur, such that the antiknock property tends to fall, and in certain internal combustion engines, the required combustion output cannot be produced.

Furthermore, adding a known stabilizer and antirust and the like to this fuel would not cause any problems.

In addition, although the main objective of the fuel of the present invention is its use as an alternative to gasoline for internal combustion engines of automobiles, ships and boats and the like, it is of course possible to use this fuel by mixing it with gasoline, and also to use it as other industrial fuels and household fuels.

Next, the fuel of the present invention will be explained by embodiments and test results, but these will not limit the present invention in any way.

EMBODIMENT 1

A fuel of the compound given below was made by using the mixed alcohol comprising alcohol of (1) to (3) as follows. The order of mixing each component is arbitrary.

| | |
|---|---|
| Mixed alcohol: | 52 percentage by weight |
| (1) methanol | 36 percentage by weight |
| (2) isopropyl alcohol | 10 percentage by weight |
| (3) isobutanol | 6 percentage by weight |
| toluene | 33 percentage by weight |
| paraffinic hydrocarbon (hexane) | 15 percentage by weight |

EMBODIMENT 2

A fuel of the compound described below was made by using a mixed alcohol of Embodiment 1, of which methanol was replaced with ethanol.

| | |
|---|---|
| Mixed alcohol: | 53 percentage by weight |
| (1) ethanol | 44 percentage by weight |
| (2) isopropyl alcohol | 3 percentage by weight |
| (3) isobutanol | 6 percentage by weight |
| toluene | 29 percentage by weight |
| paraffinic hydrocarbon (hexane) | 18 percentage by weight |

Test Result 1

When the octane number of the fuel in Embodiment 1 above was compared with the standard value of gasoline, while the standard value of gasoline with regard to the octane number for high-octane gasoline and regular gasoline was 95 and 85, respectively, the octane number of the fuel of the present invention was 104.3.

Test Result 2

A 10.15 mode method test was conducted on the fuel of embodiment 2 above, using a test car with an engine having a total emission of 1500 cc (type: Toyota E-AE110). The results of this test indicated a fuel efficiency of 8.9 km/l, a similar value to that of gasoline (8.7 km/1). The components found in the exhaust gas were as follows. (Testing body: Japanese Automobile Transport Technology Association)

| Component | Embodiment 2 | Gasoline |
|---|---|---|
| CO | 1.19 ppm | 193.01 ppm |
| HC | 6.36 ppmc | 10.86 ppmc |
| $NO_x$ | 38.81 ppm | 6.96 ppm |
| $CO_2$ | 0.841% | 0.848% |

The results of this test indicate that, in the fuel of the present invention, CO is controlled to approximately ⅕ and HC to approximately ½ compared to those of gasoline, and the fact that CO is low indicates that complete combustion of the fuel has taken place.

In addition, because the fuel of the present invention does not contain reformed gasoline, substantially no sulfur oxides exist in the exhaust gas.

Test Result 3

With respect to the fuel as described in Embodiment 2, heat quantity, engine revolutions, mileage, ignition point, copper corrosion, gum test and octane number were compared to those of gasoline fuel, and the results of all of the above could easily stand comparison with those of gasoline.

The testing results of the ignition point and flash point etc. for the fuel of the present invention are as follows. (Testing body: Tokyo Kagaku Bunseki Center)

| | Embodiment 2 | Gasoline |
|---|---|---|
| Ignition point | 404° C. | 300° C. |
| Flash point | −14.4° C. | −40° C. |
| Copper corrosion | 1 | 1 |
| Gum test | 0 | 0 |
| Octane number | 104.3 | 85 (regular)/95 (high-octane) |

As is clear from the detailed explanation above, the alternative fuel to gasoline in the present invention emits very little exhaust gas that contains CO, HC, $CO_2$, $SO_x$, which are causes of pollution, and further displays performance that easily stands comparison with gasoline in terms of heat quantity, engine revolution, mileage, horsepower etc., thereby being extremely useful as a low-pollution fuel that can be used for internal combustion engines instead of gasoline.

We claim:

1. An alternative fuel to gasoline, said fuel including alcohol as the principal component;

wherein said alcohol is a mixed alcohol of ethanol and/or methanol and isopropyl alcohol and isobutanol;

and said alternative fuel to gasoline includes said mixed alcohol and hexane and toluene.

2. An alternative to gasoline, said fuel including alcohol as the principal component;

wherein said alcohol is a mixed alcohol of 9~6:1.5~0.5:2~1 weight ratio of ethanol and/or methanol and isopropyl alcohol and isobutanol; and said alternative fuel to gasoline included a fuel comprised of 51~60 percentage by weight of said mixed alcohol with 15~25 percentage by weight of hexane and 25~35 percentage by weight of toluene.

* * * * *